US005388433A

United States Patent [19]

Andersson et al.

[11] Patent Number: 5,388,433

[45] Date of Patent: Feb. 14, 1995

[54] ANTI-THEFT CLIP WITH BURSTING FLUID

[76] Inventors: Per-Olof Andersson, Box 211, S-183 23 Täby; Georg von Rosen, Heimdalsvägen 1, S-184 51 Österskär, both of Sweden

[21] Appl. No.: 862,746

[22] PCT Filed: Dec. 13, 1990

[86] PCT No.: PCT/SE90/00833

§ 371 Date: Jun. 4, 1993

§ 102(e) Date: Jun. 4, 1993

[87] PCT Pub. No.: WO91/09388

PCT Pub. Date: Jun. 27, 1991

[30] Foreign Application Priority Data

Dec. 14, 1989 [SE] Sweden ..... 8904246
Mar. 21, 1990 [SE] Sweden ..... 9001028

[51] Int. Cl.[6] ..... A44B 9/00

[52] U.S. Cl. ..... 70/57.1; 24/704.1; 109/25; 109/29

[58] Field of Search ..... 70/57.1; 24/704.1, 711.4, 24/711.5; 109/20, 25, 29–34, 38; 340/574; 116/77

[56] References Cited

U.S. PATENT DOCUMENTS

| | | | |
|---|---|---|---|
| 3,564,525 | 2/1971 | Robeson et al. | 109/25 |
| 4,483,049 | 11/1984 | Gustavsson et al. | 70/57.1 |
| 4,649,833 | 3/1987 | Cummins | 109/25 |
| 4,670,950 | 6/1987 | Wisecup et al. | 70/57.1 |
| 4,722,435 | 2/1988 | Mareels et al. | 109/25 X |
| 4,852,502 | 8/1989 | Klingberg et al. | 109/25 |
| 5,088,165 | 2/1992 | Minasy et al. | 24/711.4 X |
| 5,196,828 | 3/1993 | Keniston | 109/25 X |
| 5,293,674 | 3/1994 | Hendrikx | 24/704.1 |

FOREIGN PATENT DOCUMENTS

| | | | |
|---|---|---|---|
| 0033661 | 8/1981 | European Pat. Off. | 340/574 |

*Primary Examiner*—Lloyd A. Gall
*Attorney, Agent, or Firm*—Nies, Kurz, Bergert & Tamburro

[57] ABSTRACT

A device, the purpose of which is to prevent theft from stores by rendering the stolen object unusable for the thief. There is a radio loop transmitting a directed and coded signal which in turn is received by a receiver in the device. The receiver decodes the signal and transforms it to a start impulse for the release mechanism in the device. Hereby a glass or plastic ampule in the device is destroyed and its content, a fluid, spreads under pressure through holes in the device and renders the theft-protected item unusable.

6 Claims, 2 Drawing Sheets

ANTI-THEFT CLIP WITH BURSTING FLUID

PURPOSE OF INVENTION

The invention refers to a device aimed at preventing theft of displayed goods in shops, consists of a clip with a first and a second arm kept together with a hinge in one end of the arms.

The purpose of the invention is to prevent theft from stores by rendering the stolen object unusable for the thief.

BACKGROUND OF INVENTION

1. Field of The Invention

The situation for retail stores is problematic. Shoplifting is increasing and in 1988 amounted to approximately 2000 million Swedish Crowns, in the Swedish clothing retail market alone.

The type of thieves differ depending on the location of the shops but generally speaking, they could look just ordinary. No specific category of persons can be declared suspect-free in advance. It might be a senior citizen looking for excitement, a well dressed businessman who "forgot" to pay, a housewife wearing a fur coat specially designed for shop-lifting or teen-agers who consider stealing to be smart and a "tough" thing to do.

Considering these facts, the shop attendants, who are to watch the articles in the shop and see to it that they are not stolen, cannot categorize a person in advance as a "typical" shop-lifter.

A considerable part of the shop attendants' time and energy is therefore directed to "watching" the customers instead of performing their proper tasks—to sell and give service. Furthermore, the shop becomes a place where suspicion has to be directed on everybody.

The solution is for the staff to apply anti-theft devices to the articles in the shop.

This is done to a large extent, but unfortunately the alarm systems are far from perfect, as is proved by the afore-noted figure 2000 million Swedish Crowns as the value of stolen clothes in Sweden during one year.

Some clothes shops in exposed locations have to calculate with a loss in stolen articles amounting to 8% of the total turn over.

2. Description of The Prior Art

The predominant anti-theft technique used today is a device consisting of an anti-theft tab fastened to the article that is to be protected, and a detector that reacts when an anti-theft tab passes by. When this happens, the detector makes a noise that makes the staff aware of the attempted theft.

Unfortunately there are several techniques to "cheat" the systems with rather simple methods—e.g. it is possible to screen off the electronics or to remove the tab from the article by pinching off the lock-pin.

A few years ago another alarm system was introduced to the market—the so called "paint-clip". In this system there are no signals or other means to attract attention to the fact that an attempt at a theft is taking place. Instead with this technique, if the clip is removed in an incorrect manner, there is a risk that the stolen article becomes discolored.

The weakness of this system is that the thief can steal a number of theft-protected articles from the shop without being noticed, then coax the alarms out in another place, and maybe succeed with some.

Specially constructed tools for opening the alarm without breaking them also exist.

The problems of shop-lifting thus are of three different types.

1. The anti-theft tabs are coaxed open inside the shop and removed from the article, usually by pinching off the lock-pin.
2. The stolen item is removed from the shop with the alarm still attached whilst the anti-theft tab is screened off so that the signal from it does not activate the detector.
3. Articles protected with paint-clips are removed from the shop and the alarm is opened in a safe place.

SUMMARY OF THE INVENTION

Against the background of these procedures we hereby apply for a patent for a device that with a new technique will render it considerably more difficult in all possible ways to steal from shops.

The device is based on the knowledge that a new pattern of thefts is surfacing, especially in our large cities where gangs operate simultaneously in the whole store.

They take with them what they want and they don't mind the noise from the alarm system when they pass through the exit—running.

Being identified as thieves by the public is not of any real concern to them, since in the gang it is considered smart to steal.

All the existing alarm systems are based on the presumption that the staff should intervene when articles are illegally removed from the store, whether they be supplied with anti-theft alarms or not.

The knowledge about this and the fear of being hurt in such situations involves a severe psychic stress among the staff, who in the clothing stores are often young girls, and can easily create feelings of discomfort and powerlessness. The device for which patent is applied for here transfers the responsibility for watch keeping from the staff to the alarm system on the goods.

If a thief tries to steal an article that is protected with the device for which patent is applied for here, the built-in fluid capsule will inevitably burst and destroy the stolen garment in a devastating manner.

The incentive for attempting to steal thereby disappears.

Further features and objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings in which.

DESCRIPTION OF THE PREFERRED EMBODIMENT

Figure 1A:
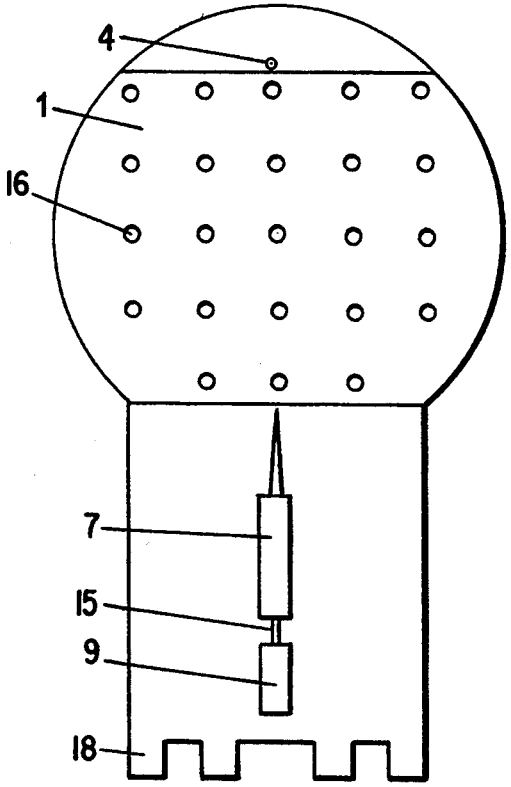
FIG. 1A shows a bottom plan view of the first upper arm (1) of the clip device in FIG. 1C.
Figure 1B:
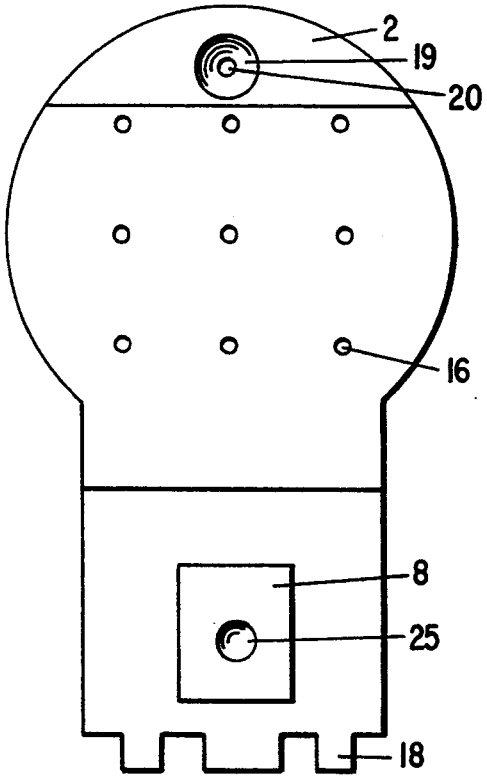
FIG. 1B shows a top plan view of the second lower arm (2) of the clip device in FIG. 1C.
Figure 1C:
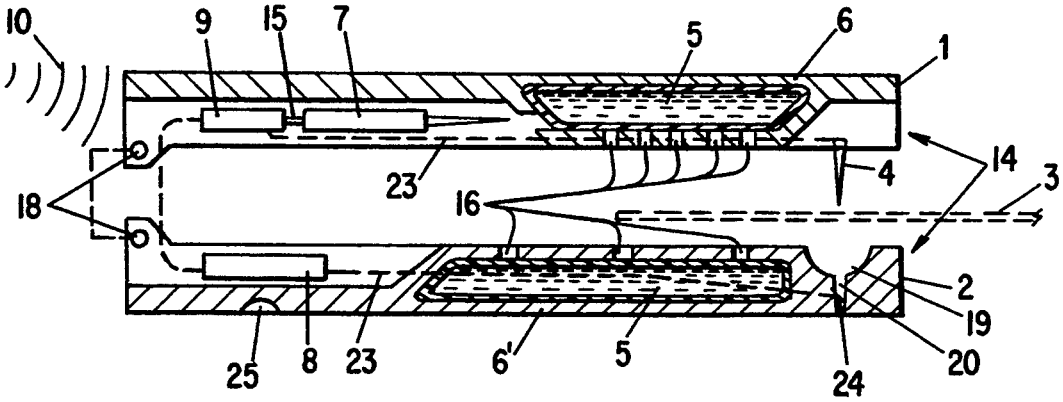
FIG. 1C shows a vertical schematic section view of the alarm clip in its position when locking on the item (3) that is to be theft protected.

FIG. 1 shows the device for which patent is applied.

The device consists of a hinged clip with a first (1) and a second (2) arm, joined by hinging ears 18 at one end, the clip having an opened and a closed position.

The item (3) that is to be theft-protected is placed between the two arms of the clip (1,2) whereafter the clip is closed and a spike (4) that is fastened in the first arm (1) pierces the theft-protected item (3) and goes into and is guided by the cavity or depression 19 and cooperative locking hole 20 in the second arm (2) in which the spike is locked. In the two arms (1,2) is enclosed a fluid (5) in a glass or plastic ampule (6,6'). Since the fluid (5) in the ampules in the two arms (1,2) will be disposed over other components in the arms (1,2) the positioning of the ampule and fluid (5) provides an extra protection, making it impossible to reach the other components whitout rupturing the ampule, causing leakage of fluid which would destroy the theft-protected item.

In case of an attempted theft, a release mechanism (7) will cause the glass or plastic ampule (6) in the first arm (1) to detonate and be ruptured causing the enclosed fluid (5) to spill over the article, making it unusable.

The second arm (2) contains a source of current supply (8) with three functions: a) to supply the release mechanism (7) in the first arm (1) with the energy needed to make possible the detonation of the glass or plastic ampule (6) in the first arm (1); b) to see to it that when the clip is in a locked position, a closed circuit (23) is formed by pin 4 engaging a contact 24 in the locking hole 20, and when this circuit is unduly broken, make possible a detonation for destruction of the glass or plastic ampule in the first arm (1) via the release mechanism (7); c) to supply the indicator (25) in the second arm (2) with enough energy to produce an obvious indication in order to make the staff aware that the source of current supply (8) is approaching the lowest acceptable level of energy that will safeguard the energy dependent functions of the alarm.

The closed circuit (23) can only be broken in an approved manner by using an opening tool which is individualised for each store.

The second arm (2) is exchangeable so that when an indication of low energy level has been registered from the indicator (25), a new second arm (2) with maximum energy level can be connected to the first arm (1) and thereby set the first one (1) working again.

The first arm (1) contains a receiver (9) which allows it to respond to an external coded signal (10).

The purpose of making the external signal (10) possible to code, and also making it possible to use different codes for different users, is to decrease the risk that a thief may disturb the external signal (10).

Figure 2:
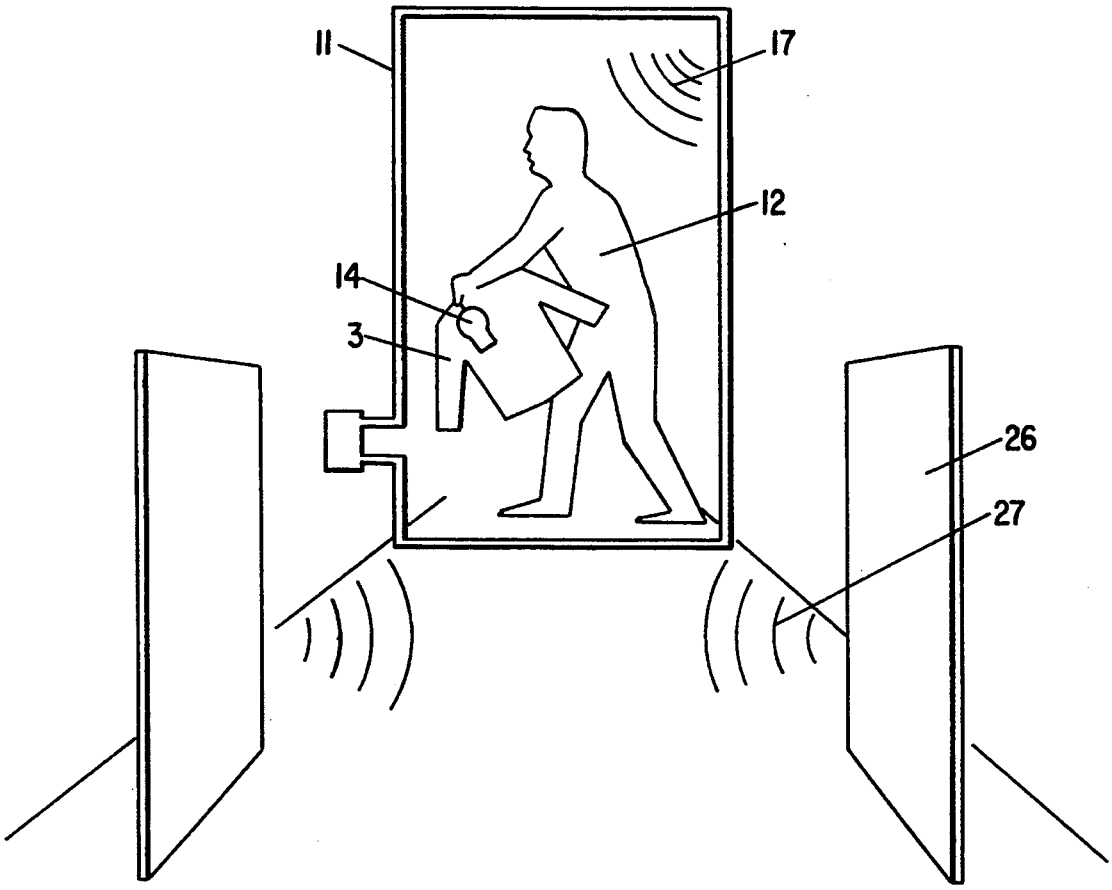
FIG. 2 shows an example of a shop environment where the alarm may be used.

FIG. 2 shows an outline of principle of the shop environment in which the device, for which patent is applied for, is to be used.

The signal (10) is conducted from a "radio-loop" (11) positioned at the shop exit (17) that is to be guarded. When the thief (12) passes by the "radio-loop" (11) with a stolen item (3) the signal (10) is registered by the receiver (9) in the device (14) which reacts by transforming the signal (10) to initiating start energy via connection (15) the release mechanism (7) which causes the fluid capsule (6) to detonate and spread the fluid through the holes (16) in the arm 1 of the device so that the fluid spills over the garment.

On the way towards the exit (17) an early warning system (26) gives a warning signal (27) aimed at attracting attention to the attempted theft or to a possible false alarm under way. The purpose of this early warning system is to prevent unnecessary destruction of goods.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A device for preventing theft of displayed goods in shops comprising: a clip consisting of a first and a second arm, each arm having two ends, hinge means joining one set of the ends of each of the two arms, and locking means comprising parts on the other set of ends of each of the two arms, said two arms having an open condition, enabling an item of displayed goods to be protected to be inserted between the other set of ends of the two arms, and a closed condition wherein said locking means engages said item to be protected and locks the other set of ends of the two arms together and to the item to be protected; a rupturable ampule contained in at least said first of said arms; fluid contained in said ampule; said first arm including a release mechanism for detonating and rupturing said ampule in said first arm to make said fluid spill over the item locked between the two arms; said two arms including electrical circuitry means with a circuit, including said release mechanism, closed by said two arms being in said closed and locked condition; and said circuitry means including a receiver with means for activating the release mechanism responsive to receiving an external coded signal and responsive to the closed electrical circuit being improperly broken.

2. A device as set forth in claim 1, wherein said rupturable ampule is made from a material selected from a group of materials consisting of glass and plastic.

3. A device as set forth in claim 2, wherein a fluid filled rupturable ampule is contained in the second of said arms, rupturing of which will result in fluid being spilled from said second arm over the item being protected.

4. A device as defined in claim 3, wherein said ampules form extra protection against tampering with circuitry components contained in the two arms.

5. A device as defined in claim 1, in combination with means for generating an external coded signal, and including means enabling said external signal to be coded differently in order to render noise suppression more difficult.

6. A device as defined in claim 1, wherein said receiver decodes the external coded signal and transforms it to an initiating impulse for activating the release mechanism.

* * * * *